US005456451A

United States Patent [19]

Eyler, Jr.

[11] Patent Number: 5,456,451

[45] Date of Patent: Oct. 10, 1995

[54] SAFETY RAILING POST AND BRACKETS THEREFOR

[76] Inventor: Charles W. Eyler, Jr., 13249 Creagerstown Rd., Thurmont, Md. 21788

[21] Appl. No.: 231,907

[22] Filed: Apr. 25, 1994

Related U.S. Application Data

[63] Continuation-in-part of Ser. No. 79,933, Jul. 30, 1993, abandoned.

[51] Int. Cl.[6] ..... E04G 27/00

[52] U.S. Cl. ..... 256/67; 256/65; 256/DIG. 6

[58] Field of Search ..... 256/67, 65, 59, 256/DIG. 6; 182/113; 403/49; 52/721, 665, 702, 645, 648.1, 646, 263, 637, 638

[56] References Cited

U.S. PATENT DOCUMENTS

| | | | |
|---|---|---|---|
| 346,019 | 7/1886 | Birck | 182/113 |
| 2,332,477 | 10/1943 | Thornley | 182/113 X |
| 3,756,568 | 9/1973 | Mocny | 256/65 X |
| 3,776,521 | 12/1973 | Weinert . | |
| 3,804,374 | 4/1974 | Thom | 256/65 X |
| 3,848,854 | 11/1974 | De Barbieri . | |
| 3,881,698 | 5/1975 | Marsh . | |
| 4,830,341 | 5/1989 | Arteau . | |

FOREIGN PATENT DOCUMENTS

| | | | |
|---|---|---|---|
| 631147 | 2/1925 | France | 256/67 |
| 584560 | 12/1927 | France | 256/65 |
| 2621639 | 4/1989 | France | 256/65 |
| 2243629 | 11/1991 | United Kingdom | 256/59 |

*Primary Examiner*—Anthony Knight

[57] ABSTRACT

The present invention relates to hand railing that complies with Occupational Safety and Health Administration (OSHA) regulations for hand railing on both landings and stair cases. The hand railing utilizes a post which can be converted by angling a bracket to accommodate various stair case inclinations. The brackets can also be pivoted into an upper position when used in a landing position to create horizontal railing supports.

8 Claims, 3 Drawing Sheets

SAFETY RAILING POST AND BRACKETS THEREFOR

CROSS REFERENCE TO RELATED APPLICATIONS

This application is a continuation-in-part of U.S. patent application Ser. No. 08/079,933, filed Jul. 30, 1993, now abandoned.

BACKGROUND OF THE INVENTION

The present invention relates to hand railing and more particularly to safety railing used at construction sites.

According to current Occupational Safety and Health Administration (OSHA) standards, safety railing must be provided at construction sites on elevated areas whether planar, concrete pads for instance, or inclined, e.g. stair case. OSHA standards require that the height of the railing for stair cases be at a minimum of approximately 36 inches from the surface. On planar surfaces the requirement is that the height be a minimum of approximately 42 inches.

Safety railing is necessary at construction sites to prevent accidents. Such railing prevents personnel from falling and also keeps loose tools and debris from being inadvertently kicked over the edge of an elevated surface. Examples of such safety railings are disclosed in the following U.S. Patents.

| Inventor(s) | U.S. Pat. No. |
|---|---|
| Mocny et al. | 3,756,568 |
| Marsh | 3,881,698 |
| De Barbieri | 3,848,854 |
| Arteau et al. | 4,830,341 |
| Weinert | 3,776,521 |

Mocny disclose a removable guard rail stanchion having a two part post and two brackets for securing horizontal railings to the post. The brackets are fixed in position by bolts so that the openings of the brackets are facing upwardly for reception of the railings. The post and bracket assembly of Mocny are designed for use on a floor or concrete slab, but not on a stair case.

Marsh, De Barbieri, Arteau, and Weinert disclose examples of safety railings, but none are disclosed as being usable on a stair case, or on a combination of surfaces such as a stair case and landing.

SUMMARY OF THE INVENTION

The present invention is directed to temporary safety railing used at construction sites and various other areas where railing is required for limited lengths of time to prevent injury to workers. The railing includes a post constructed with a plurality of brackets that are pivotable about an axis that is perpendicular to the length of the post. Because the brackets are pivotable, the post can be used on a stair case or ramp to accommodate the angle of inclination of the stairs or ramp. Since all stairs or ramps do not have the same angle of inclination it is necessary for the bracket to be freely pivotable about an axis to meet the needs of different situations.

It is therefore an object of the present invention to provide a bracket that is pivotable about an axis to accommodate various inclinations of stairs or ramps. Further, it is an object of the present invention to provide post that can be utilized to transition from a stair case or ramp to a planar surface. Another object of the invention is to provide a bracket that can be pivoted from an inclined position when used on stairs to a horizontal position when used on a landing.

For a more through discussion of the present invention and its advantages, reference should be made to the attached drawings and detailed description of the preferred embodiment that follows.

DESCRIPTION OF THE PREFERRED EMBODIMENTS

Figure 1:
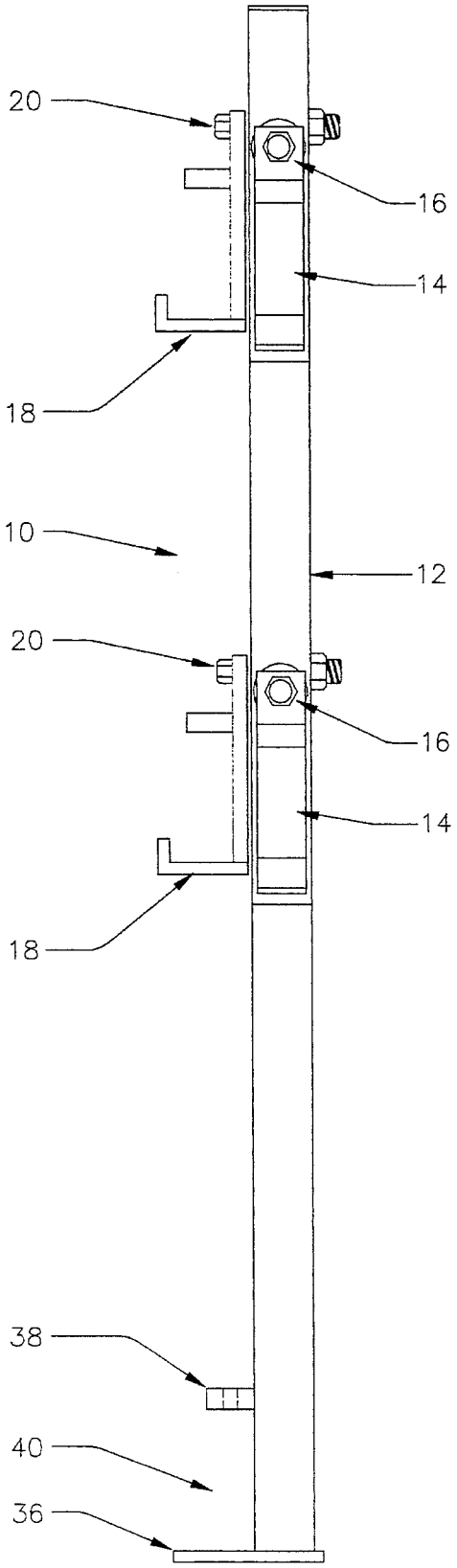
FIG. 1 is a side view illustrating a preferred embodiment of the present invention.

Referring now to FIG. 1, Post 10 is illustrated. Post 10 includes a vertically extending post member 12 made preferable of a hollow tubular steel post. Post member 12 is generally made from stock construction materials. Post member 12 is square in cross-section and includes on one face a pair of brackets 14 attached to post member 12 by screws or bolts 16. Bolts 16 operate as pivot axes for brackets 14, the operation of which will be explain more fully below.

Brackets 18 are attached to post member 12 by screws or bolts 20. Brackets 18 are similar in construction to brackets 14. Brackets 18 are attached to a face of post member 12 that is perpendicular to the face that contains brackets 14. Bolts 20 function similar to bolts 16, and thus allow brackets 18 to be pivotably attached to post member 12.

Figure 2:
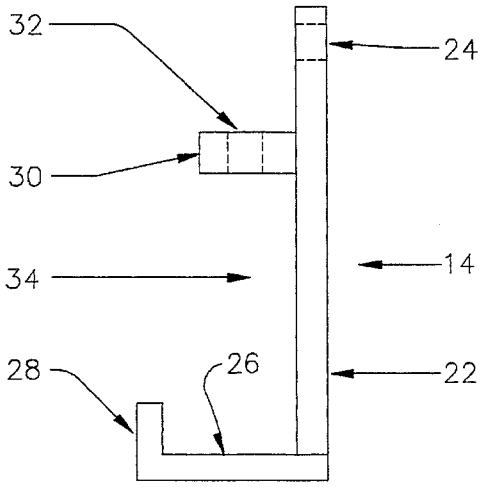
FIG. 2 illustrates a side view of a bracket of the present invention detached from the post.

FIG. 2 is a close up view of the bracket 14. Bracket 14 includes a vertical member 22 having an aperture 24 at one end for reception of bolt 16. An L-shaped base member 26 is attached to the other end of vertical member 22 and includes a flanged portion 28 that extends upwardly towards the end of vertical member 22 that contains aperture 24. Positioned between the ends of vertical member 22 is an intermediate member 30. An aperture 32 is formed in intermediate member 30 for reception of a fastener, such as a nail or a screw, for attaching a railing to the bracket and hence to the post. The railing fits within space 34 defined by L-shaped base member 26 and intermediate member 30. Flange 28 is used to prevent the railing from moving away from the bracket before a fastener can be installed in aperture 32.

As shown in FIG. 1, a base 36 is attached to the bottom of post member 12. Positioned above base 36 is an attachment member 38 having an aperture similar to aperture 32. Base member 36 and attachment member 38 define a space 40 for reception of a toe board which is held in position by a fastener passing through the aperture in attachment member 38. In the landing situation, FIG. 3, a toe board 50 is included to prevent debris from being inadvertently kicked off the landing.

Figure 3:
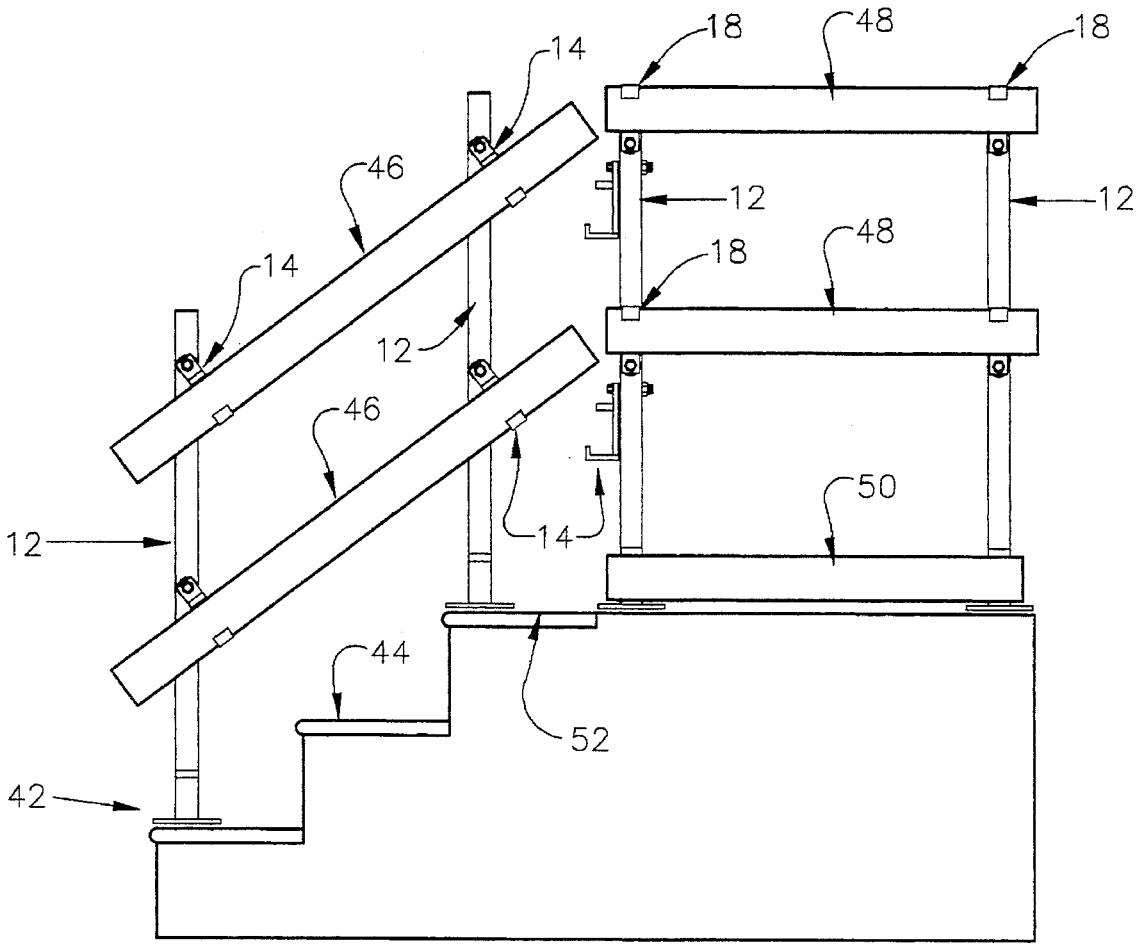
FIG. 3 illustrates the post of FIG. 1 attached to a stair case and also used on a landing.

In FIG. 3, the post and bracket assembly are positioned on a staircase 42 having a number of treads 44. Railing members 46 are attached to brackets 14 on the staircase in angled position such that railing members 46 allow a person to grasp the railing while climbing staircase 42. At the top of staircase 42 is a landing 52 and a plurality of posts 12. The versatility of the invention allows the post to be used on a landing, as well as a staircase. However, the brackets 18 must be pivoted into the up position so that the railing members are at the proper height. It should be noted that brackets 14 can be used on the landing instead of the staircase and brackets 18 can be used on the staircase.

Figure 4:
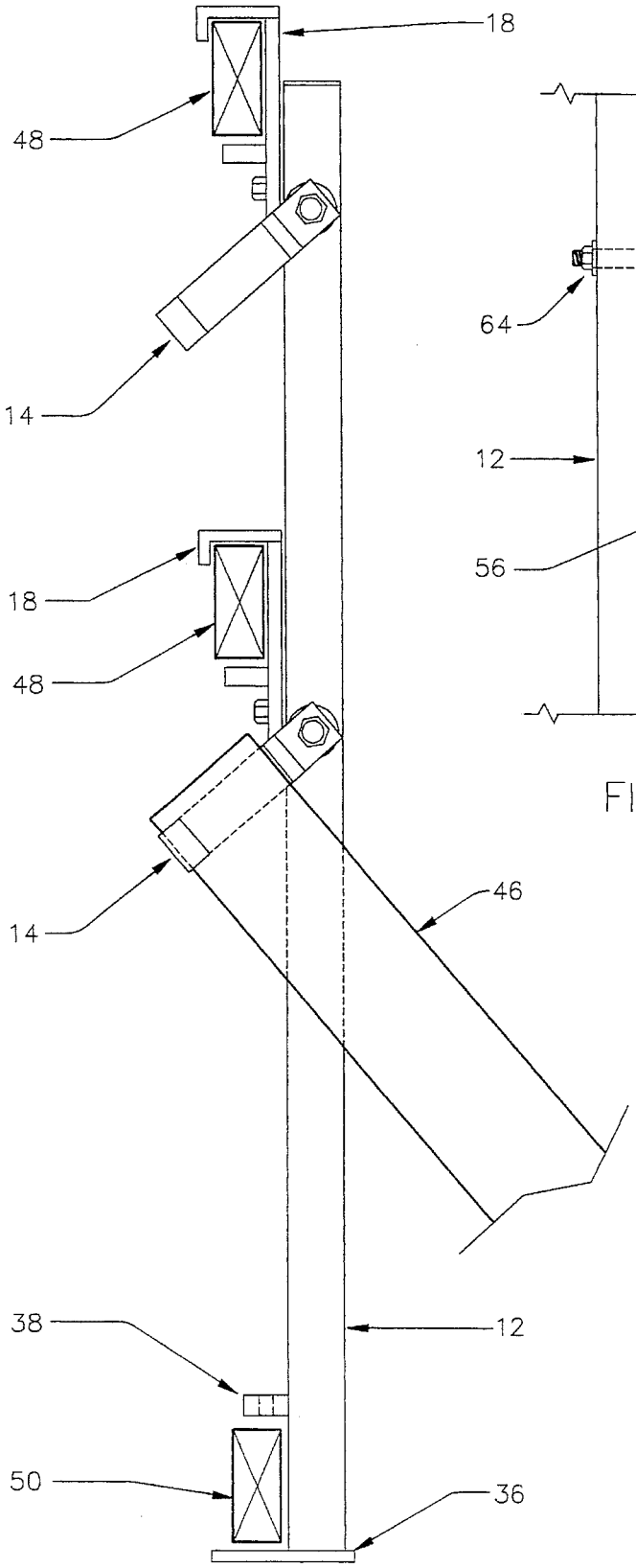
FIG. 4 illustrates a close up view of the post of FIG. 1, utilized to accommodate a stair case and a landing.

FIG. 4 illustrates the use of post 12 having four brackets 14 and 18. Brackets 14 are shown as being pivoted into an angled position to provide for staircase railing members 46. Brackets 18 are pivoted into the upper position to provide for horizontal railing members 48. Brackets 14 and 18 are shown with bracket 14 being positioned below bracket 18. However, the position of the brackets could be reversed. The post and bracket assembly thus allows for corners to be turned while using only a single post, and for the walking surfaces at the corner to be at different angles of inclination relative to each other.

Figure 5:
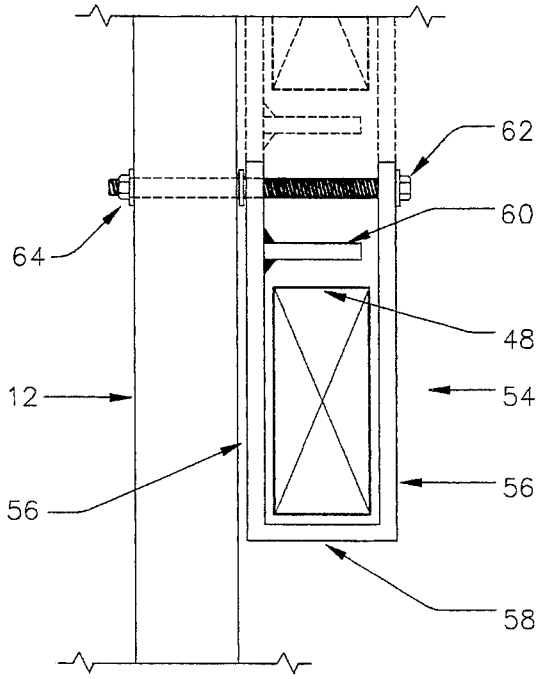
FIG. 5 illustrates an alternative embodiment of the present invention.

An alternative embodiment of the invention is illustrated in FIG. 5. FIG. 5 shows a bracket 54 attached to post 12 by bolt 62 and nut 64 type fastener. Nut 64 is welded to post 12 to prevent turning, but nut 64 may be free rotatable relative to post 12 and tightened on bolt 62 by a wrench or similar tool. Bracket 54 is U-shaped with a pair of legs 56 and a base portion 58. Horizontal railing member 48 is positioned in the U-shaped bracket 54 with the railing 48 positioned on base portion 58. As bolt 62 or nut 64 is tightened, the legs 56 of U-shaped bracket 54 are brought together to clamp the horizontal railing in position. A tongue 60 is provided on one of the bracket legs to prevent over stressing of the bracket by stopping inward movement of legs 56. Additionally, tongue 60 also acts to support railing member 48 when the bracket is pivoted into the upper position, as shown in phantom in FIG. 5.

The present invention has been described above with regards to several preferred embodiments of the invention. Various modifications and equivalents will be apparent to persons of ordinary skill in the art. The invention desired to be secured by Letters Patent is defined by the claims that follow.

I claim:

1. A safety railing post comprising:

a vertically extending elongated member;

a base attached to said elongated member for fixing said elongated member to a staircase tread or a horizontal planar surface;

a first bracket attached to said elongated member in pivotable fashion so that said bracket may be pivoted to accommodate the angular incline of a staircase to which said elongated member is attached so that when a stair railing member is attached to said bracket, said stair railing member is at substantially the same angle of inclination as the staircase; and a second bracket attached to said elongate member in pivotable fashion and disposed generally perpendicular to said first bracket, said second bracket being pivotable between a first down position and a second up position.

2. The safety railing post as recited in claim 1 wherein said first down position and said second up position are generally 180 degrees apart, and when a railing member is placed within the bracket in either position, the railing member is substantially parallel to the horizontal planar surface.

3. A safety railing post comprising:

a vertically extending elongated member;

a base attached to said elongated member for fixing said elongated member to a surface; and at least one bracket attached to said elongated member, said bracket being attached to said elongated member about a pivot axis so that said bracket can be pivoted to accommodate various angular inclines, or be disposed substantially parallel with said elongated member, said bracket having a vertical member with an aperture at one end for accepting a pin so that said bracket may be attached to said elongated member and when so attached constitutes the pivot axis of said bracket, a base member attached to said vertical member at an opposite end, and an intermediate member attached to said vertical member between said one end and said opposite end, said base member and said intermediate member cooperating to attach a railing member to said bracket.

4. The safety railing post as recited in claim 3 wherein said base member is L-shaped so that the railing member is prevented from moving in a direction parallel to said pivot axis.

5. The safety railing post as recited in claim 3 wherein said intermediate member includes an aperture for receiving a fastener so that the railing member is attached to said bracket.

6. The safety railing post as recited in claim 4 wherein said intermediate member includes an aperture for receiving a fastener so that the railing member is attached to said bracket.

7. A safety railing post comprising:

a vertically extending elongated member;

a base attached to said elongated member for fixing said elongated member to a surface; and at least one bracket attached to said elongated member, said bracket being U-shaped and including two legs attached to and extending from a base portion, said legs including an aperture for reception of a fastener for attaching said bracket to said elongated member so that said bracket is pivotable with respect thereto and also for causing said legs to be drawn towards one another for clamping a railing member therebetween.

8. The safety railing post as recited in claim 7 further comprising an intermediate member positioned between said legs to prevent over stressing of said legs.

* * * * *